US005280714A

United States Patent [19]

Shore et al.

[11] Patent Number: 5,280,714

[45] Date of Patent: Jan. 25, 1994

[54] FINISHING BLOCK WITH DUAL SPEED SIZING CAPABILITY

[75] Inventors: Terence M. Shore, Princeton; Melicher Puchovsky, Dudley, both of Mass.

[73] Assignee: Morgan Construction Company, Worcester, Mass.

[21] Appl. No.: 920,609

[22] Filed: Jul. 27, 1992

[51] Int. Cl.[5] ..... B21B 35/00

[52] U.S. Cl. ..... 72/249

[58] Field of Search ..... 72/234, 235, 249, 366.2

[56] References Cited

U.S. PATENT DOCUMENTS

| | | | |
|---|---|---|---|
| 3,129,618 | 4/1964 | Hergeth | 72/249 |
| 3,992,915 | 11/1976 | Hermes et al. | 72/249 |
| 4,024,746 | 5/1977 | Brück | 72/249 |
| 4,807,458 | 2/1989 | Buch et al. | 72/249 |

FOREIGN PATENT DOCUMENTS

| | | | |
|---|---|---|---|
| 827341 | 2/1960 | United Kingdom | 72/249 |

*Primary Examiner*—Lowell A. Larson
*Assistant Examiner*—Thomas C. Schoeffler
*Attorney, Agent, or Firm*—Samuels, Gauthier & Stevens

[57] ABSTRACT

A block type rolling mill having work roll pairs arranged along a rolling line to roll a single strand product in a twist-free manner, wherein the work roll pairs are driven by a common mill drive via a drive train which includes first and second line shafts extending in parallel relationship with the rolling line, and intermediate drive means for mechanically interconnecting two successive work roll pairs interposed between the two successive work roll pairs and the first and second line shafts, and first and second engagement means for alternatively connecting the intermediate drive means to one or the other of the first and second line shafts via respective first and second intermeshed gear sets having different gear ratios.

7 Claims, 4 Drawing Sheets

FINISHING BLOCK WITH DUAL SPEED SIZING CAPABILITY

BACKGROUND OF THE INVENTION

1. Field of the Invention

This invention relates generally to rolling mills, and is concerned in particular with an improvement in single strand finishing blocks of the type employed to roll rods, bars and other like products in a twist-free manner.

2. Description of the Prior Art

An example of a well known single strand finishing block is described in U.S. Pat. No. 4,537,055, the disclosure of which is herein incorporated by reference. In this type of finishing block, successive roll stands have oppositely inclined pairs of grooved cantilevered work rolls. The block is driven by a common drive connected by means of a gear type speed increaser to a pair of line shafts extending in parallel relationship to the rolling line. Successive roll pairs are alternatively connected by means of intermediate drive components to one or the other of the line shafts. The intermediate drive components include intermeshed gears which provide fixed interstand speed ratios designed to accommodate the increasing speed of the product as it is rolled through the block.

The cross section of a product exiting from a conventional finishing block normally will be within tolerances which are acceptable for some but not all purposes. For example, a properly rolled 5.5 mm round will have a tolerance at or slightly below the limit of ±0.15 mm as specified by ASTM-A29. Such products may be used "as is" for many applications, including for example wire mesh, etc. For other uses, however, such as for example cold heading, spring and valve steels, much tighter tolerances on the order of ¼ ASTM are required. Such products are commonly referred to as "precision rounds". In the past, this level of precision has been achieved either by subjecting the product to a separate machining operation after the rolling operation has been completed, or by continuously rolling the product through additional separately driven so-called "sizing stands". Sizing stands are conventionally arranged successively to roll products in a round-round pass sequence, with reductions in each pass being relatively light, e.g., 3.0%-13.5% as compared with reductions on the order of 20% per stand taken during normal rolling.

The sizing stands can be arranged in a separately driven block located downstream from the finishing block, or they can be incorporated as part of the finishing block. Separately driven sizing stands add significantly to the overall cost of the mill, and in some cases this arrangement may be impractical due to physical space limitations. The incorporation of the sizing stands into the finishing block minimizes these drawbacks. However, in the past, the fixed interstand drive speed ratios which exist between the successive stands of conventional finishing blocks has presented a limitation on the extent to which integrally incorporated sizing stands can be utilized.

For example, if the last two stands of a ten stand finishing block are adapted to operate as sizing stands, they can normally size rounds having a particular diameter and travelling at a particular speed as they exit from the preceding eighth stand. Should the rolling schedule subsequently call for a larger round, the normal practice would be to "dummy" (render inoperative) one or more successive pairs of stands in the finishing block in order to obtain the desired larger product. However, because the last two stands are operating at the same constant speed, they cannot accept the larger slower moving product. Thus, they too must be dummied, making it impossible to size the larger product.

SUMMARY OF THE INVENTION

The basic objective of the present invention is to broaden the range of products that can be rolled by sizing stands integrally incorporated into the finishing block.

In a preferred embodiment to be hereinafter described in greater detail, this and other objectives and advantages are achieved in a finishing block having work roll pairs arranged along a rolling line to roll a single strand product in a twist-free manner. The work roll pairs are driven by a common mill drive via a drive train which includes first and second line shafts extending in parallel relationship with the rolling line. Two successive roll stands, preferably the last two in the finishing block, are adapted to operate as sizing stands. The sizing stands are mechanically interconnected to one another by intermediate drive components which include a cross shaft extending transversely between the first and second line shafts. First and second sets of intermeshed bevel gears and associated clutch mechanisms serve to alternatively connect the cross shaft to one or the other of the first and second line shafts. The first and second bevel gear sets have different gear ratios. Thus, the sizing stands will be driven at different speeds depending on which line shaft and associated gear set is employed to drive the cross shaft.

DETAILED DESCRIPTION OF PREFERRED EMBODIMENT

Figure 1:
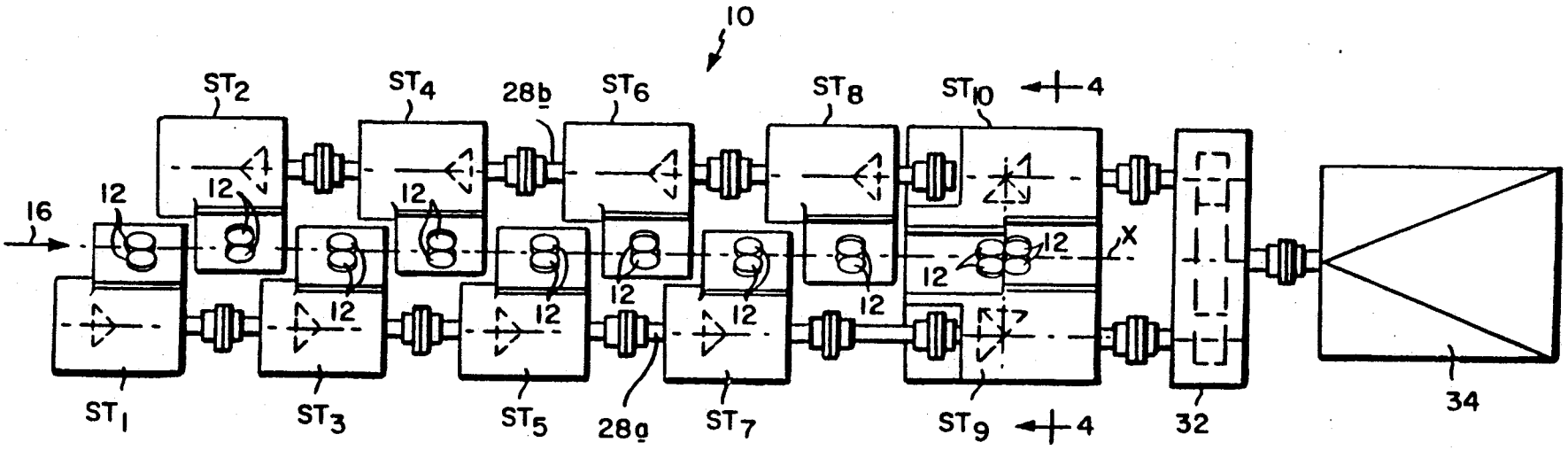
FIG. 1 is a plan view of finishing block in accordance with the present invention.

Referring initially to FIG. 1, a finishing block in accordance with the present invention is generally depicted at 10. The block includes a plurality of roll stands $ST_1$-$ST_{10}$, each having respective work roll pairs 12 arranged along a rolling line "X" to roll a single strand product in a twist-free manner. The work roll pairs of stands $ST_1$-$ST_8$ are configured to effect normal reductions on the order of 20%, in an oval-round pass sequence. The work roll pairs of stands $ST_9$ and $ST_{10}$ are more closely spaced than those of the prior stands and are adapted to size products in a round-round pass sequence. Entry and delivery guides (not shown) serve to direct the product along the rolling line X from one roll pass to the next in the direction indicated at 16 in FIG. 1.

Figure 2:
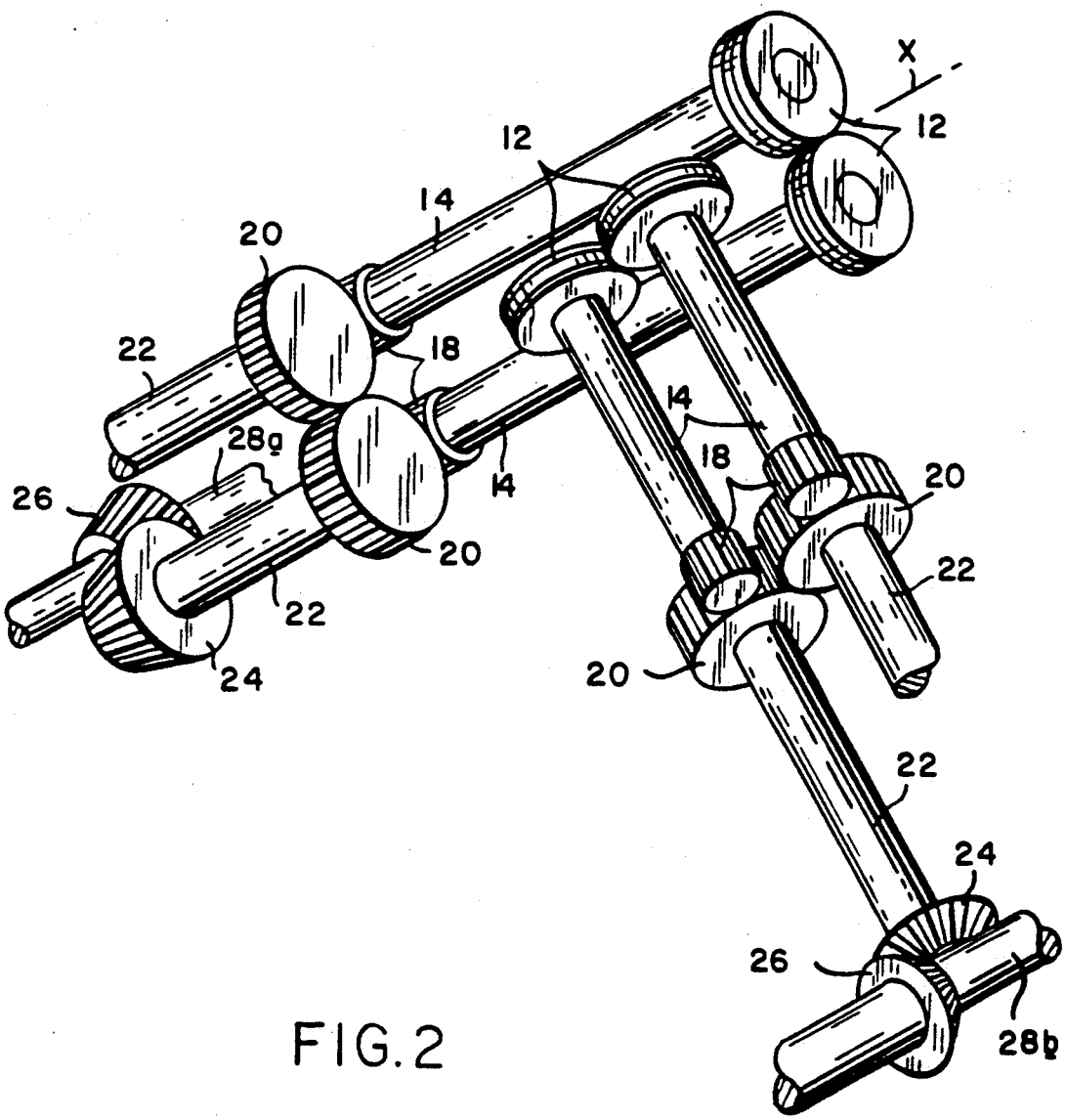
FIG. 2 is a diagrammatic three dimensional view illustrating the components used to drive the rolls of typical reduction stands located in advance of the sizing stands in the finishing block.

FIG. 2 illustrates the typical arrangement of intermediate drive components for any two successive reduction roll pairs in the stand series $ST_1$-$ST_8$. The work rolls 12 are mounted in cantilever fashion on pairs of roll shafts 14 carrying pinion gears 18. The pinion gears are spaced one from the other and are in meshed relationship respectively with intermeshed spur gears 20, the latter being carried on pairs of intermediate drive shafts 22. One of the intermediate drive shafts of each pair carries a driven bevel gear 24 which meshes with a drive bevel gear 26 on one of two segmented line shafts 28*a*, 28*b* extending in parallel relationship with the rolling line X. The gear ratios of the intermeshed bevel gears 24, 26 are selected to accommodate the progressively increasing speed of the product as it is rolled through the block, while at the same time insuring that the product remains under slight tension as it passes from one roll pair to the next. Although not shown, it will be understood that mechanisms are provided to symmetrically adjust the roll shafts 14 and the work rolls 12 carried thereon with respect to the rolling line X. The segmented line shafts 28*a*, 28*b* are connected to a gear type speed increaser 32 which in turn is driven by a common mill drive, in this case a variable speed electric motor 34.

Figure 3:
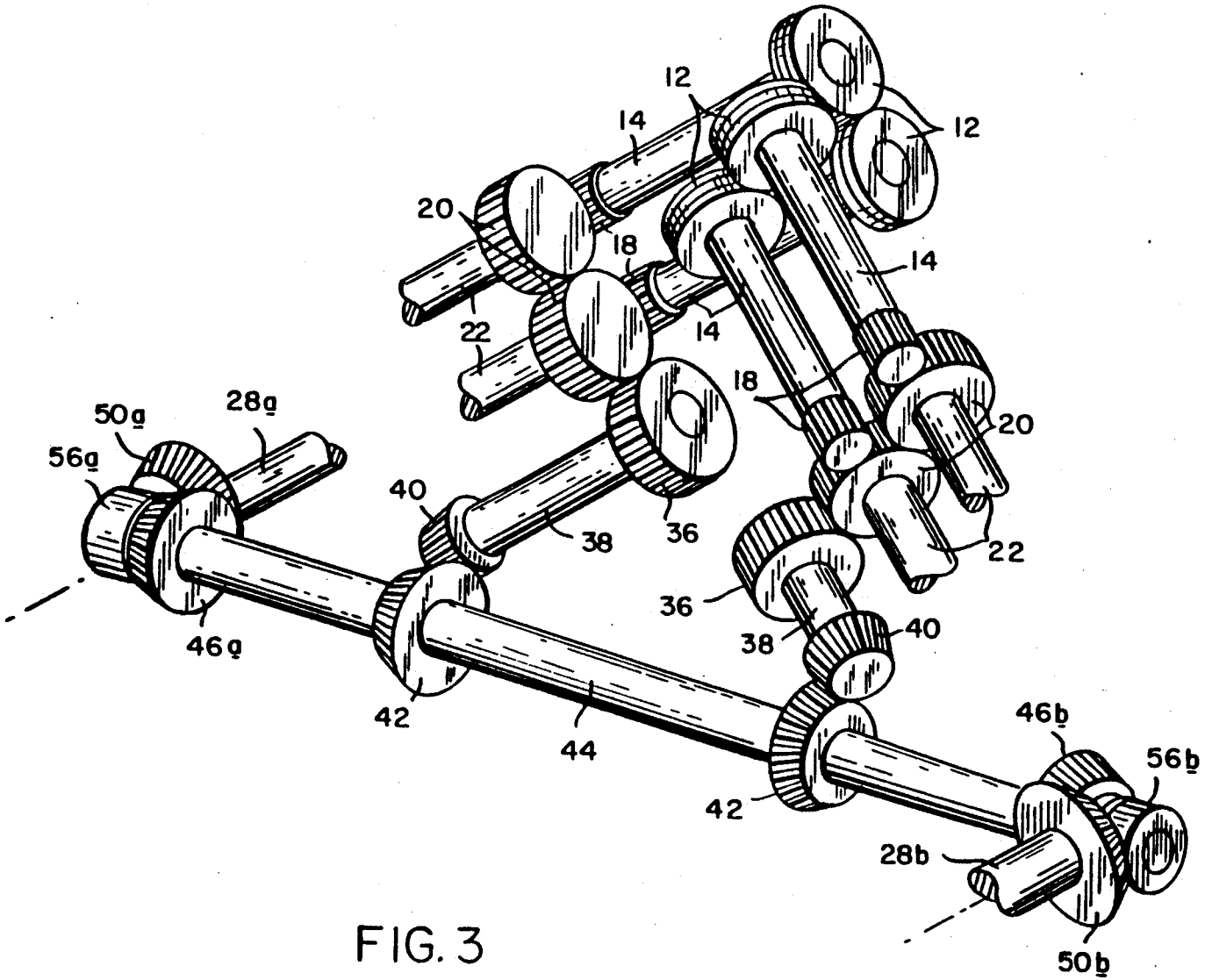
FIG. 3 is a view similar to FIG. 2 illustrating the drive components for the rolls of the sizing stands in the finishing block.

The foregoing is representative of conventional designs now well known and widely employed by those skilled in the art. The present invention, which centers on the last two roll stands $S_9$, $S_{10}$, will now be described with further reference to FIGS. 3 and 4. FIG. 3 is intended to be diagrammatically illustrative, it being understood that the arrangement of components may be altered by those skilled in the art to accommodate various operating requirements and conditions. It will be seen that the sizing roll pairs 12 of stands $S_9$, $S_{10}$ also are mounted in cantilever fashion on roll shafts 14 carrying pinion gears 18. The pinion gears are in meshed relationship respectively with spur gears 20 carried on intermediate drive shafts 22. One of the intermeshed spur gears 20 is additionally in meshed engagement with a third spur gear 36 carried on a third intermediate drive shaft 38. The third intermediate drive shafts additionally carry intermediate driven bevel gears 40 which are in meshed relationship with intermediate drive bevel gears 42 carried on and rotatably fixed with respect to a cross shaft 44 extending transversely between the two segmented line shafts 28*a*, 28*b*.

The cross shaft 44 has driven bevel gears 46*a*, 46*b* rotatably mounted thereon by means of roller bearings 41. The bevel gears 46*a*, 46*b* are in mesh respectively with drive bevel gears 50*a*, 50*b* carried on the segmented line shafts 28*a*, 28*b*.

Each of the driven bevel gears 46*a*, 46*b* has a toothed outer face 52 adapted to be engaged by the toothed inner face 54 of a respective clutch sleeve 56*a*, 56*b*. The clutch sleeves 56*a*, 56*b* are rotatably fixed to the cross shaft 44 by keys 58 which permit the sleeves to slide axially to and fro in order to engage and disengage their toothed inner faces 54 with the toothed outer faces 52 on the respective bevel gears 46*a*, 46*b*.

Figure 4:
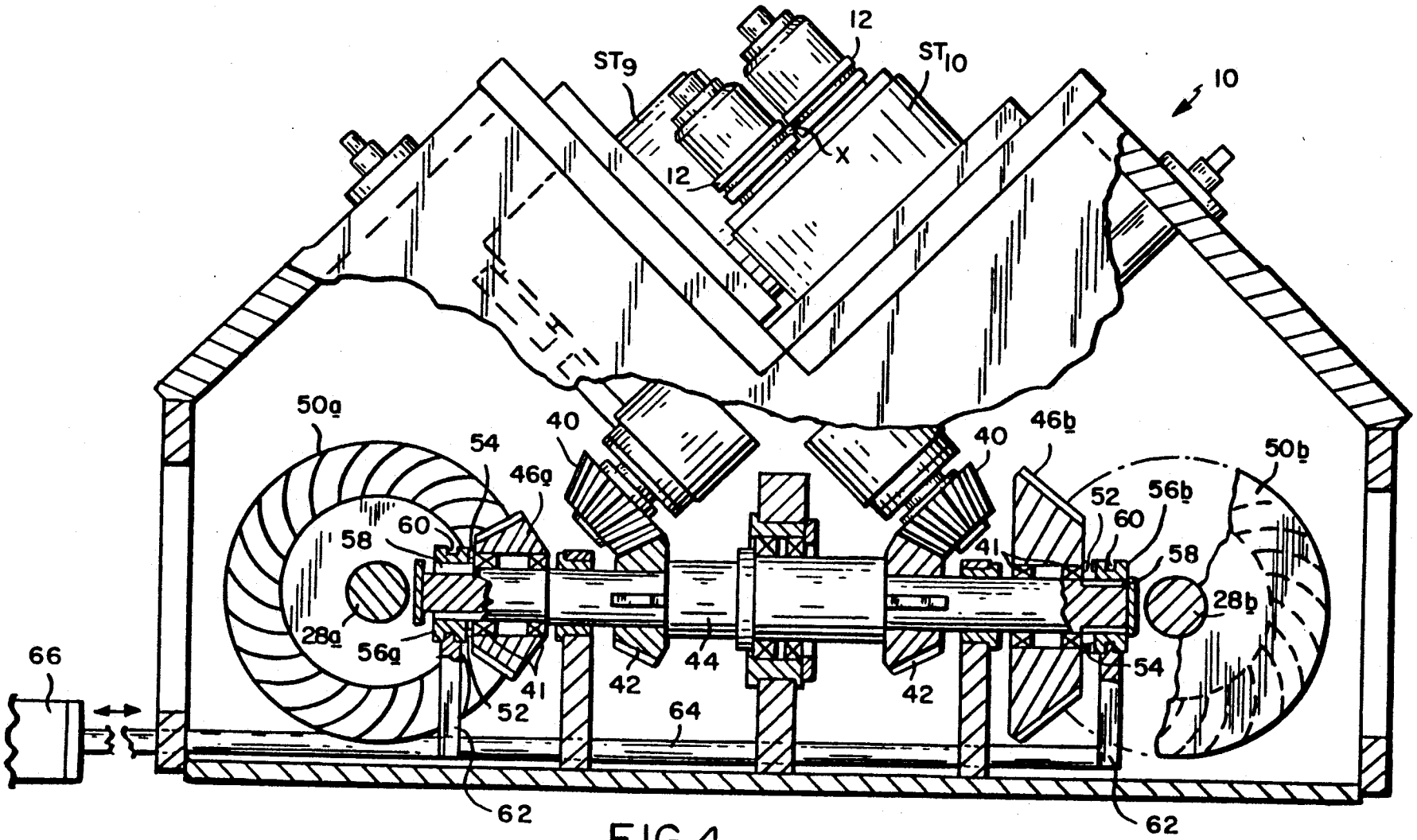
FIG. 4 is a partial sectional view on an enlarged scale taken along line 4—4 of FIG. 1.

As shown in FIG. 4, the clutch sleeves 56*a*, 56*b* have circumferential external grooves 60 engaged by forks 62 carried on a common slide bar 64 operated by any conventional mechanism such as for example the piston-cylinder unit 66 shown in FIG. 4. The spacing of the forks 62 is such that when one clutch sleeve is engaged, the other is disengaged.

The gear ratios of the intermeshed bevel gear sets 46*a*, 50*a* and 46*b*, 50*b* are different one from the other, with the gear set 46*a*, 50*a* imparting a higher speed to the cross shaft 44 as compared to the drive speed derived from gear set 46*b*, 50*b*.

In light of the foregoing, it will now be appreciated by those skilled in the art that the present invention offers the capability of significantly broadening the range of products which can be rolled in the sizing stands $ST_9$, $ST_{10}$. For example, in a typical rolling operation, the finishing block 10 will be fed with a 14 mm round. As the product progresses through the reduction stands $ST_1$–$ST_8$, its cross section will be progressively reduced, with stands $ST_2$, $ST_4$, $ST_6$ and $ST_8$ respectively rolling 11.5 mm, 9.0 mm, 7.0 mm and 5.5 mm rounds. With the slide bar 64 adjusted to the position shown in FIG. 4, the sizing stands $ST_9$, $ST_{10}$ will be driven in a high speed mode by the line shaft 28*a* via intermeshed bevel gears 46*a*, 50*a*. This mode will allow stands $ST_9$, $ST_{10}$ to size the smaller diameter 5.5 mm round emerging from stand $ST_8$. If a larger precision round is desired, stands $ST_1$ and $ST_2$ or stands $ST_7$ and $ST_8$ may be dummied to feed stands $ST_9$, $ST_{10}$ with a 7.0 mm round. In this case, the slide bar 64 will be shifted to its alternative setting, thus coupling the cross shaft 44 to line shaft 28*b* via intermeshed bevel gears 46*b*, 50*b*. The sizing stands $ST_9$, $ST_{10}$ will thus be driven at a lower speed to accommodate the slower 7.0 mm product.

We claim:

1. In a block type rolling mill having work roll pairs arranged along a rolling line to roll a single strand product in twist-free manner, said work roll pairs being driven by a common mill drive via a drive train which includes first and second line shafts extending in parallel relationship with the rolling line, the improvement comprising:

intermediate drive means for mechanically interconnecting two successive work roll pairs, said intermediate drive means being interposed in said drive train between said two successive work roll pairs and said first and second line shafts; and first and second engagement means for alternatively connecting said intermediate drive means to one or the other of said first and second line shafts via respective first and second intermeshed gear sets, said first and second intermeshed gear sets having different gear ratios.

2. The rolling mill of claim 1 wherein said intermediate drive means includes a cross shaft extending transversely between said first and second line shafts.

3. The rolling mill of claim 2 wherein opposite ends of said cross shaft are mechanically connected to said first and second line shafts by said first and second intermeshed gear sets.

4. The rolling mill of claim 3 wherein said first and second intermeshed gear sets each includes a drive bevel gear on a respective one of said line shafts in meshed relationship with a driven bevel gear at a respective end of said cross shaft.

5. The rolling mill of claim 4 wherein said engagement means further includes clutch means for rotatably engaging and disengaging said driven bevel gears with respect to said cross shaft.

6. The rolling mill of claim 5 wherein said clutch means includes clutch members rotatably fixed on and movable axially along said cross shaft between rotatably engaged and disengaged positions with respect to said driven bevel gears.

7. The rolling mill of claim 6 wherein said clutch members are interconnected in a manner such that engagement of one clutch member is accompanied by disengagement of the other clutch member.

* * * * *